US011368781B2

(12) United States Patent
Enquist et al.

(10) Patent No.: US 11,368,781 B2
(45) Date of Patent: Jun. 21, 2022

(54) COLLAPSIBLE HEADPHONE

(71) Applicant: Zound Industries International AB, Stockholm (SE)

(72) Inventors: Andreas Enquist, Stockholm (SE); Jacob Andersson, Stockholm (SE)

(73) Assignee: Zound Industries International AB, Stockholm (SE)

( * ) Notice: Subject to any disclaimer, the term of this patent is extended or adjusted under 35 U.S.C. 154(b) by 0 days.

(21) Appl. No.: 17/121,424

(22) Filed: Dec. 14, 2020

(65) Prior Publication Data

US 2021/0195313 A1 Jun. 24, 2021

(30) Foreign Application Priority Data

Dec. 20, 2019 (SE) ..... 1951528-7

(51) Int. Cl.
*H04R 25/00* (2006.01)
*H04R 1/10* (2006.01)

(52) U.S. Cl.
CPC ..... *H04R 1/1066* (2013.01); *H04R 1/1041* (2013.01); *H04R 1/1008* (2013.01)

(58) Field of Classification Search
CPC ..... H04R 1/1066; H04R 1/1041
See application file for complete search history.

(56) References Cited

U.S. PATENT DOCUMENTS 4,597,469 A * 7/1986 Nagashima ..... H04R 5/0335 181/129
5,293,647 A 3/1994 Mirmilshteyn et al.
8,363,877 B2 1/2013 Morisawa
9,301,039 B2 * 3/2016 Brunner ..... H04R 1/1066
9,522,086 B2 12/2016 Jenkins et al.
9,536,515 B2 1/2017 Oide
2004/0213428 A1 * 10/2004 Lenhard-Backhaus ..... H04R 1/1066 381/370
2004/0216946 A1 * 11/2004 Lenhard-Backhaus ..... H04R 1/1066 181/129
2005/0053255 A1 3/2005 Harris et al.
(Continued)

FOREIGN PATENT DOCUMENTS

CN 202435579 U 9/2012
EP 1587342 A2 10/2005
EP 3244629 A1 11/2017

OTHER PUBLICATIONS

Swedish Search Report for Patent Application No. 1951528-7 dated Jun. 7, 2020.

*Primary Examiner* — Simon King
(74) *Attorney, Agent, or Firm* — Knobbe, Martens, Olson & Bear, LLP

(57) ABSTRACT

This disclosure presents a collapsible headphone comprising earpieces having inner sides facing the head of a user when the headphone is worn. The headphone further comprises a headband and joint structures connecting the earpieces to the headband. Each joint structure has a hinge joint and a pivot joint wherein the hinge joints connect the earpieces to the headband via the pivot joints. Each hinge joint comprises a hinge axis and each pivot joint comprises a pivot axis, the hinge axes being non-parallel to the pivot axes. The headphone is collapsible to a collapsed configuration where said inner sides are arranged essentially in parallel with the headband and facing each other.

16 Claims, 7 Drawing Sheets

(56) References Cited

U.S. PATENT DOCUMENTS

| | | | | |
|---|---|---|---|---|
| 2009/0041267 | A1* | 2/2009 | Lee | H04R 5/033 381/104 |
| 2011/0129111 | A1* | 6/2011 | Santiago | H04R 5/0335 381/379 |
| 2012/0140973 | A1* | 6/2012 | Olodort | H04R 1/1066 381/375 |
| 2012/0275615 | A1 | 11/2012 | Kelly et al. | |
| 2014/0241561 | A1 | 8/2014 | Motosugii | |
| 2018/0035197 | A1* | 2/2018 | Camello | H04R 1/10 |
| 2019/0208309 | A1 | 7/2019 | Clark et al. | |
| 2019/0320255 | A1* | 10/2019 | Cranfield | H04R 1/105 |

* cited by examiner

COLLAPSIBLE HEADPHONE

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR § 1.57. For example, this application claims priority to Sweden Application No. SE 1951528-7, filed Dec. 20, 2019, and titled "COLLAPSIBLE HEADPHONE," the entire content of which is incorporated herein by reference in its entirety and forms a part of this specification.

BACKGROUND

Field

The present disclosure generally pertains to the field of headphones, and in particular to a headphone that is comfortable and sturdy yet easy to transport.

Description of the Related Art

Headphones are commonly used for media consumption as well as for communication. Generally, a headphone should be comfortable when worn and transportable when not in use. For the latter reason, a headphone is preferably easily and quickly collapsible to a compact and protected form, preferably not requiring a transport packaging. At the same time, a headphone should be long lasting and easy to manufacture.

US20120140973A1 discloses a headphone that may be collapsed to form a short cylindrical structure that resembles a hockey puck. The headphone includes pivot joints which allow the earpieces to rotate in a first direction that is perpendicular the user's head at the position where the pivot joints are located when the headphone is worn.

US20040213428A1 discloses a headphone including two pivot joints having pivot axes that intersect one another.

EP1587342A2 and US20120275615A1 disclose headphones including hinge joints allowing the earpieces to articulate with respect to the headband and pivot joints allowing the earpieces to rotate.

SUMMARY

A general object of embodiments of this disclosure to provide a headphone that obviates or at least mitigates the disadvantages of the prior art headphones.

Accordingly, there is provided a headphone comprising earpieces comprising inner sides facing the head of a user when the headphone is worn, a headband, and joint structures connecting the earpieces to the headband, each joint structure comprising a hinge joint and a pivot joint, wherein the hinge joints connect the earpieces to the headband via the pivot joints, and each hinge joint comprises a hinge axis and each pivot joint comprises a pivot axis, the hinge axes being non-parallel to the pivot axes, and wherein the headphone is collapsible to a collapsed configuration where said inner sides are arranged essentially in parallel with the headband and facing each other.

Thanks to the headphone being collapsible so that the inner sides are arranged essentially in parallel with the headband and facing each other, closely against each other, and adjacent each other, a particularly compact collapsed configuration is achieved. The inner sides of earpieces are generally flat, and bringing these flat surfaces to face each other entails efficient use of space, as well as protecting the inner sides from mechanical damage and travel dust, while not requiring a travel packaging. The fact that the inner sides are arranged essentially in parallel with the headband brings the advantage that headband provides mechanical protection to the earpieces and also makes the collapsible configuration more compact. The headphone is easy and quickly to collapse as the user simply needs to bring the inner sides together and then rotate to align with the headband. Alternatively, the user may select to first align he earpieces with the headband and subsequently bring the inner sides thereof to face one another. Similarly, the headphone is very easy to erect from the collapsed configuration.

Thanks to the joint structures with a hinge joint and a pivot joint, a sturdy design is achieved. The hinge joint is arranged to fold the pivot joint and thus the earpieces therewith. The joint structures as described above provide a headphone that is comfortable, sturdy and comfortly fits a variety of users. By sturdy is in this connection meant that the headphone is not flimsy in a manner making it difficult to handle or fragile such that the user may by accident damage e.g. a joint when folding or erecting the headphone.

In order to be collapsed to the collapsible configuration, the joint structures should be configured to allow the earpieces to be folded in against the headband, and then rotated to face each other.

The respective hinge axis may be perpendicular to the respective pivot axis in each joint structure, or these axes may be arranged at a substantial angle with respect to each other, such as at least 60 degrees.

Preferably, the hinge joints allow the respective pivot joints and earpieces, which are carried by the pivot joints, to fold around the hinge axes towards the headband until the earpieces are positioned adjacent the headband. In this way, the headphone is very compact in the collapsed configuration, and in addition the headband provides mechanical protection to the earpieces.

The headband may be curved. The headband may have the general form of a curved beam. Preferably, the headband does not comprise any linkage or similar that allows the headband as such to be collapsed.

Preferably, the pivot joints allow the respective earpieces to rotate around the pivot axes up to but not exceeding a maximum pivot angle in both rotational directions around a neutral rotational position in which the pivot angle equals 0 degrees. Thus, the earpieces can be rotated up to the same absolute maximum pivot angle in both rotational directions. By limiting the pivot angle cable wear can be reduced, thus prolonging the life of the headphone since cables provided between the earpieces and the headband are subject to less strain. A limited pivot angle also makes the headphone easier to collapse and to use, as there is a reduced tendency of the earpieces being turned in the wrong direction. Allowing the earpieces to rotate a maximum pivot angle in both rotational directions eliminates the risk that the user inadvertently tries to collapse or erect the headphone in the wrong direction. The headphone can be brought to the collapsed configuration no matter in which rotational direction the respective earpieces are rotated to bring them to face one another.

In theory, a maximum pivot angle of 90 degrees would be sufficient for rotating the respective earpieces such that they face one another. However, depending on the overall design of the headphone a most preferred maximum pivot angle may be 120 degrees, while other embodiments allow 150 degrees or up to 180 degrees.

Preferably, the form of the headband and earpieces together with the movement allowed by the hinge joints and the pivot joints are selected such that there is essentially no gap between the headband and the earpieces in the collapsed configuration, for example no gap that exceeds the headband thickness, or even half thereof. In other words, the two earpieces fill essentially the entire area inside the curved headband. In the collapsed configuration, the earpieces may cross one another as they are aligned with respective crossing axes due to the folding around the hinge axes.

Preferably, the height of the headband essentially corresponds to the height of the earpieces in the collapsed configuration, which brings a compact collapsed configuration with an effective use of space. The height can be defined as the distance from the central point of the headband to a midpoint of its respective ends.

Preferably, the joint structures are of equal shape, which reduces, the number of unique parts required which facilities manufacturing. There are two joint structures, one supporting the left earpiece and one supporting the right earpiece. These two, left and right, joint structures may be of equal shape which means that the same component can be used on both sides, where applicable with different markings (e.g. L and R).

Preferably, the respective joint structure is configured so as to prevent rotation of the earpiece around a transverse axis to the headband in the area of the joint structure, which can be achieved by configuring the joint structure such that the pivot axis is arranged at an angle of at least 30 degrees with respect said transverse axis. This brings a particularly sturdy headphone as such rotation might impair the usability. The rotation should in particular be prevented when the headphones are worn, i.e. when the hinge joints are unfolded.

Thus, the joint structures are preferably configured such that the pivot axis is arranged at an angle $\alpha$ of at least 30 degrees with respect to the transverse axis.

Preferably, a left half of the headband and a left earpiece are of equal shape as a right half of the headband and a right earpiece. This reduces the number of unique parts required which facilities manufacturing, and also allows the user to put the headphone on, for example to take a call, without having to consider which earpiece is left and which is right. The headphone will fit both ways.

Preferably, the headphone is configured such as to remain in the collapsed configuration. This is beneficial for transport and storage, and reduces the need for a transport packaging. The user may fold the headphone to the collapsed configuration and the headphone will remain collapsed until actively erected by the user. The interlock that keeps the headphone in the collapsed configuration may be obtained by configuring the headphone such that the headband is warped in the collapsed configuration. By warped in meant that the headband is slightly twisted due to a torque experienced by the headband in the collapsed configuration, due to the design of the headphone. Since a headband is resilient it will strive to return to the unwarped condition and this causes the earpieces to be pressed against each other which results in the interlock. Thus, preferably, the headphone is configured such that the inner sides rest against each other in the collapsed configuration, and the inner sides may be pressed against each other.

Preferably, the headphone comprises telescoping joints allowing the length of the headband to be adjusted. In this way, the headphone can be further adjusted to fit different users. Preferably, the headphone is configured such that the telescoping joints can be arranged in a fully retracted position in the collapsed configuration of the headphone, which brings a compact headphone wind the telescoping joints protected from mechanical damage.

Preferably, the headphone comprises earpiece support structures connecting the joint structures to the earpieces, each earpiece support structure comprising an earpiece joint. By means of the earpiece joints, the headphone can be further adjusted to fit different users. The respective earpiece joint preferably allows the earpieces to be rotated or swivelled around an earpiece joint axis that runs in parallel with the corresponding hinge axis, the earpiece joint can therefore be denoted earpiece pivot joint.

Preferably, the earpiece support structures are yoke shaped and each comprise two earpiece pivot joints. In this way a sturdy and long lasting design is achieved which allows the earpieces to easily rotate, also under influence of a side force, around the earpiece joint axis to comfortly fit the head of the user when worn.

Preferably, a control device, such as a function button, is integrated in an earpiece joint. This is a suitable placement for a control device as the user can readily, by feeling over the surface of the headphone an in particular over the area of the earpiece joint, find and access the control device also when the headphone is worn and thus not visible to the user. By integrating the control device in an earpiece joint, there is further no need for a control device opening or similar mounting arrangement in the surface of the earpiece. This simplifies the design of equally shaped right and left earpieces. Also, a control device integrated in an earpiece joint may be better positioned no to be activated, e.g. pushed in unintentionally.

Preferably, for reasons of usability, the headphone comprises two planes of symmetry.

BRIEF DESCRIPTION OF THE DRAWINGS

These and other aspects, features and advantages will be apparent and elucidated from the following description of various embodiments, reference being made to the accompanying drawings, in which.

DETAILED DESCRIPTION

The present invention will now be described more fully hereinafter. The invention may, however, be embodied in many different forms and should not be construed as limited to the embodiments set forth herein; rather, these embodiments are provided by way of example so that this disclosure will be thorough and complete, and will fully convey the scope of the invention to those persons skilled in the art. Like reference numbers refer to like elements throughout the description.

Figure 6:
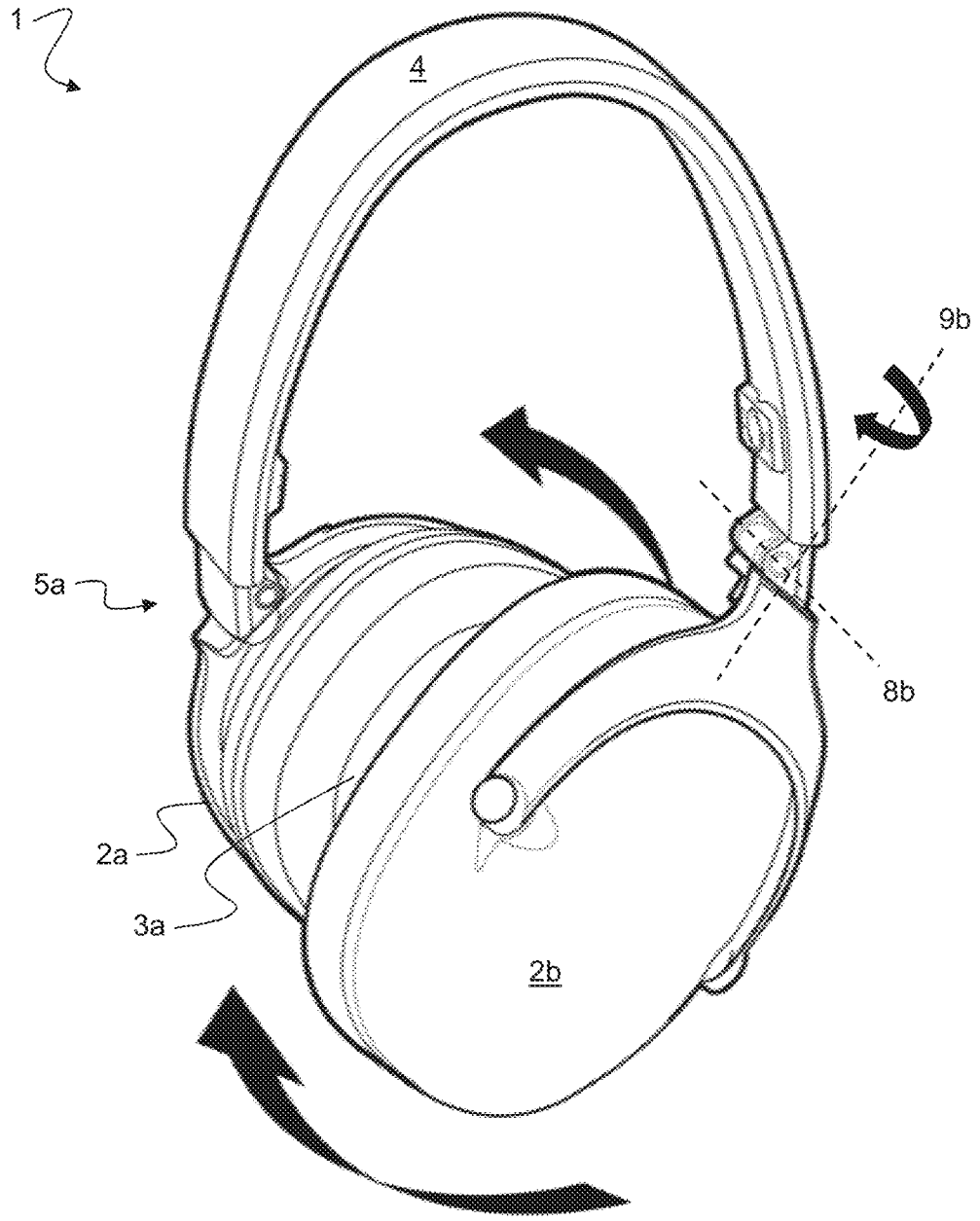
Figure 7:
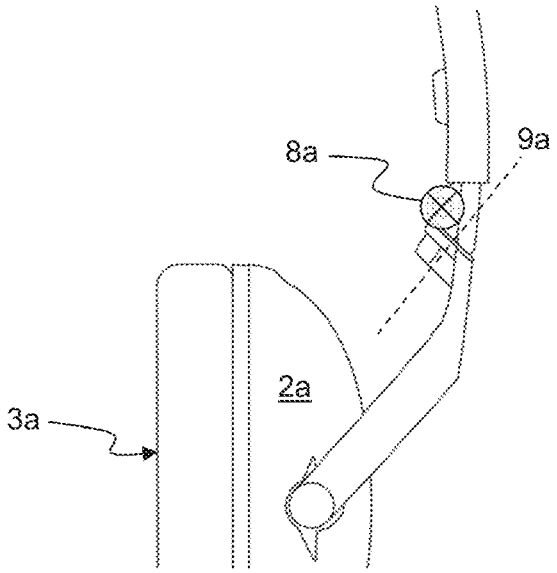
FIG. 7 is an enlarged section of FIG. 3, FIG. 8 corresponds to FIG. 7 with the earpiece folded approximately 90 degrees around a hinge joint, FIG. 9 corresponds to FIG. 8 with the earpiece in addition rotated 90 degrees around a pivot joint.
Figure 8:
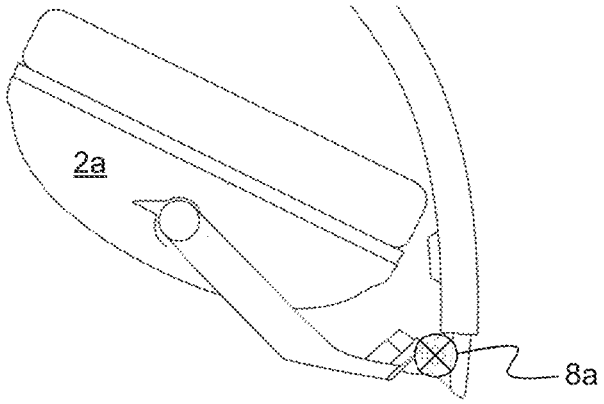
Figure 9:
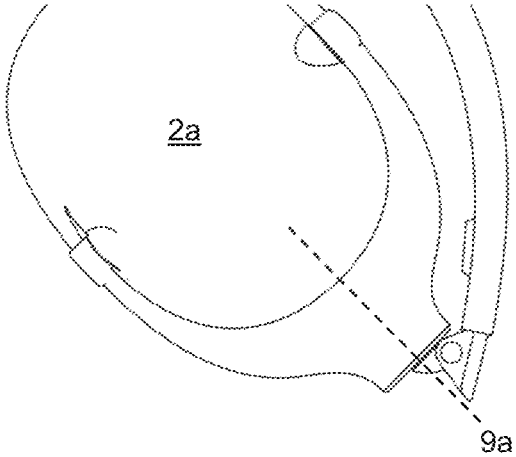

FIGS. 1-6 and 10-11 show a headphone 1 with a left earpiece 2*a* and a right earpiece 2*b*, and FIGS. 7-9 are enlarged sections of a part of the headphone 1. The earpieces 2*a*, 2*b* have inner sides 3*a*, 3*b* that are adapted to face the head of a used when the headphone 1 is worn by the user. The inner sides 3*a*, 3*b* can alternatively be termed sound emitting sides. As is illustrated (see especially FIGS. 10 and 11), the inner sides 3*a*, 3*b* are furnished with earpiece cushions or so called ear pads in order to provide good wearing comfort. The earpieces may be of the over-ear type, as shown herein, or of the on-ear type (not shown).

The earpieces 2*a*, 2*b* are connected to a curved headband 4 via joint structures 5*a*, 5*b*. Said headband 4 may be provided with a headband cushion (not shown), especially in the central portion thereof. The joint structures 5*a*, 5*b* comprise hinge joints 6*a*, 6*b* and pivot joints 7*a*, 7*b*. The hinge joints 6*a*, 6*b* connect the pivot joints 7*a*, 7*b* to the headband 4, more precisely to the headband ends 4*a*, 4*b*. The hinge joints 6*a*, 6*b* provide rotation around a hinge axis 8*a*, 8*b*, as is illustrated particularly in FIGS. 7 and 8. As can be seen, the hinge axis 8*a* runs normal to the plane of the FIGS. 7 and 8 and is illustrated by a circled cross. By means of the hinge joints 6*a*, 6*b* the pivot joints 7*a*, 7*b* may be folded into the interior of the curved headband 4, or in other words be folded inside the curved headband 4. The earpieces 2*a*, 2*b* are carried by the pivot joints 7*a*, 7*b* and therefore also the earpieces 2*a*, 2*b* are folded inside the curved headband 4 by means of the hinge joints 6*a*, 6*b*. The earpieces 2*a*, 2*b* can be folded inside the curved headband 4 to lie against the headband 4.

The hinge joints 6*a*, 6*b* allow the pivot joints 7*a*, 7*b* and the earpieces 2*a*, 2*b* to be folded around the respective hinge axis 8*a*, 8*b* which axes 8*a*, 8*b* in the illustrated example are perpendicular to a headband plane 19. The left earpiece 2*a* may be folded around a left hinge axis 8*a* and the right earpiece 2*b* may be folded around a right hinge axis 8*b*. The hinge joints 6*a*, 6*b* allow the pivot joints 7*a*, 7*b* and the earpieces 2*a*, 2*b* to fold in the headband plane 19. The headband plane 19 is illustrated by as a dashed parallelogram in FIG. 5. The headband 19 is an elongated structure with a longitudinal axis arranged in the headband plane 19.

The pivot joints 7*a*, 7*b* allow the earpieces 2*a*, 2*b* to rotate around a respective pivot axis 9*a*, 9*b*, which in the illustrated example lie in the headband plane 19. The left hinge axis 8*a* is non-parallel to the left pivot axis 9*a*. The right hinge axis 8*b* is non-parallel to the right pivot axis 9*b*. The alignment of the hinge axes 8*a*, 8*b* and the pivot axes 9*a*, 9*b* is clearly illustrated in FIGS. 6-9. In the shown example, the hinge axes 8*a*, 8*b* and the pivot axes 9*a*, 9*b* are perpendicular to one another, the angle should in similar embodiments be at least 60 degrees, preferably at least 80 degrees. The hinge axes 8*a*, 8*b* are and the pivot axes 9*a*, 9*b* as shown are perpendicular to one another no matter how the earpieces 2*a*, 2*b* are rotated around the pivot joints 7*a*, 7*b* or folded around the hinge joints 6*a*, 6*b*. As can be seen, the hinge axes 8*a*, 8*b* run perpendicular to the headband plane 19 whereas the pivot axes 9*a*, 9*b* run in parallel with the headband plane 19, and in the exemplified embodiment even in the headband plane 19.

The hinge joints 6*a*, 6*b* comprise two cooperating hinge joint elements, the first one in the exemplified embodiment being arranged perpendicular to the headband plane 19 in form of a hinge joint pin. The second hinge joint element is a hinge joint cylinder that is journalled around the hinge joint pin and thus also arranged perpendicular to the headband plane 19, see for example FIG. 5.

The pivot joints 7*a*, 7*b* comprise two cooperating pivot joint elements, the first one in the exemplified embodiment being arranged in the headband plane 19 in form of a pivot joint pin. The second pivot joint element is a pivot joint pin orifice. More precisely, the pivot joint pin orifice is a hole in which the pivot joint pin is journalled. The second hinge joint element is formed in one integral piece with the pivot joint pin, as is most clearly shown in FIG. 1. The pivot joint pin orifice is in the exemplified embodiment comprised in the earpiece support structure 13*a*, 13*b* described below.

Figure 3:
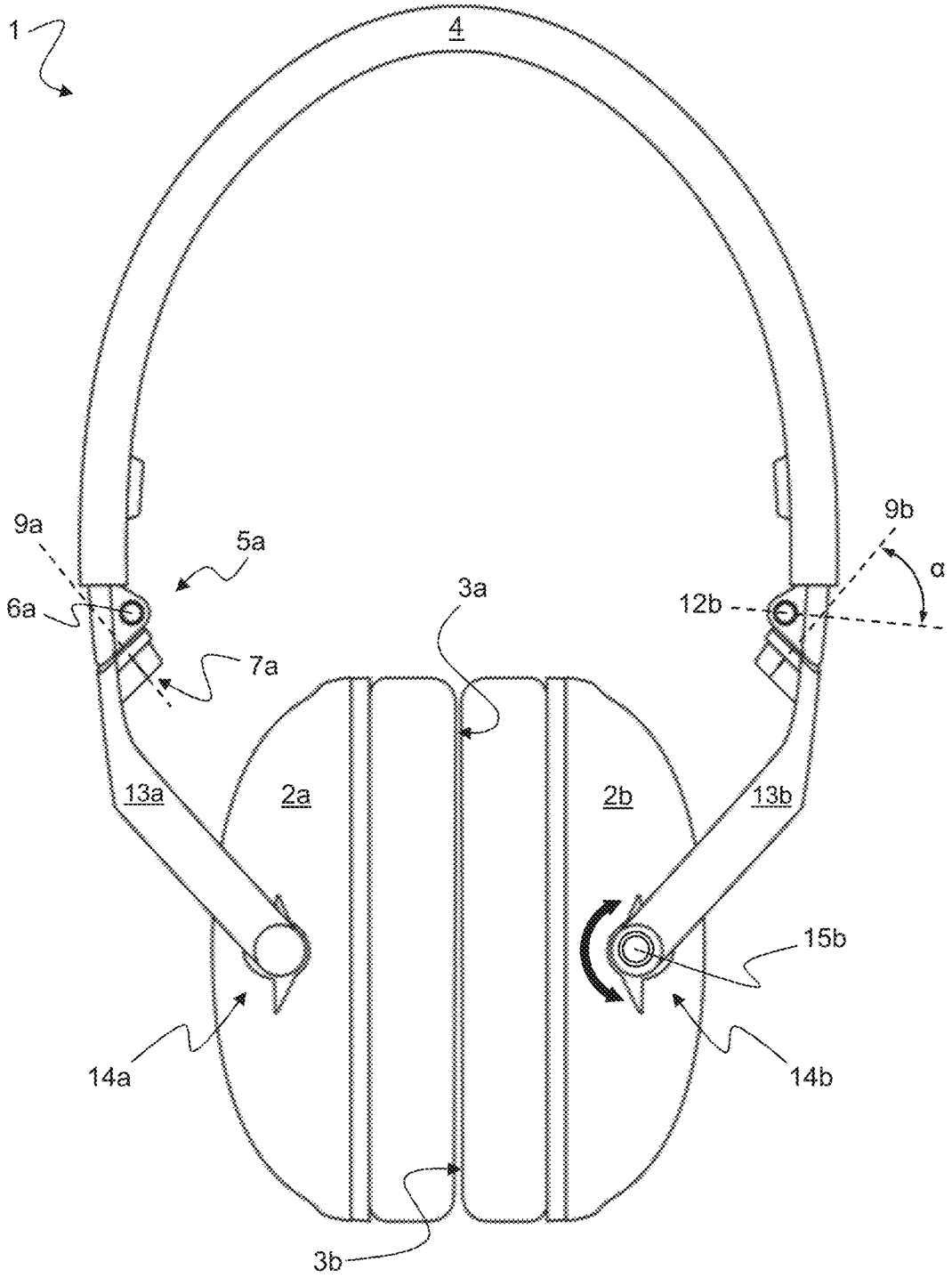
FIG. 3 is a plan view the headphone of FIG. 1 in erected configuration, FIG. 4 corresponds to FIG. 3 with extended telescoping joints.
Figure 4:
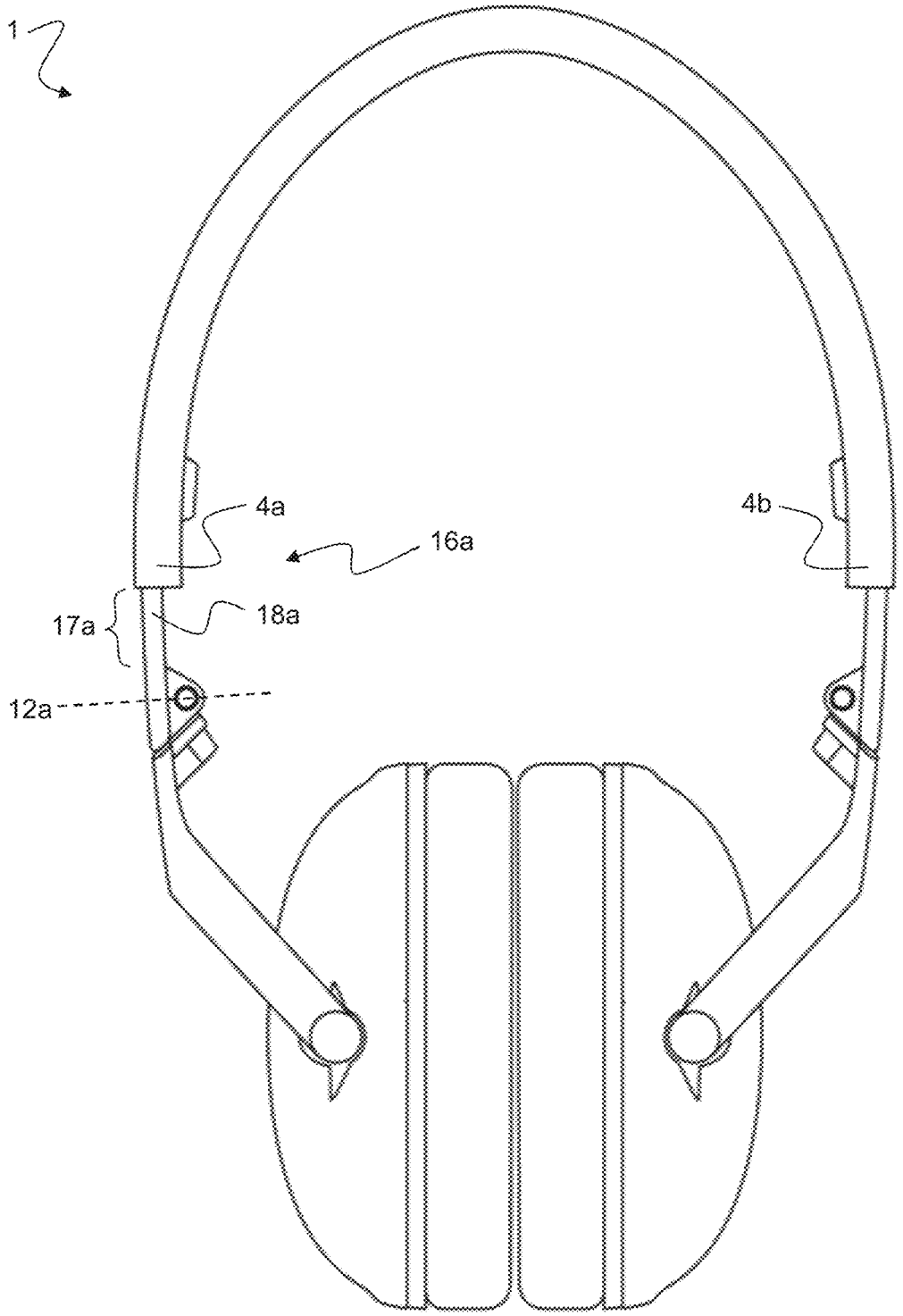
Figure 5:
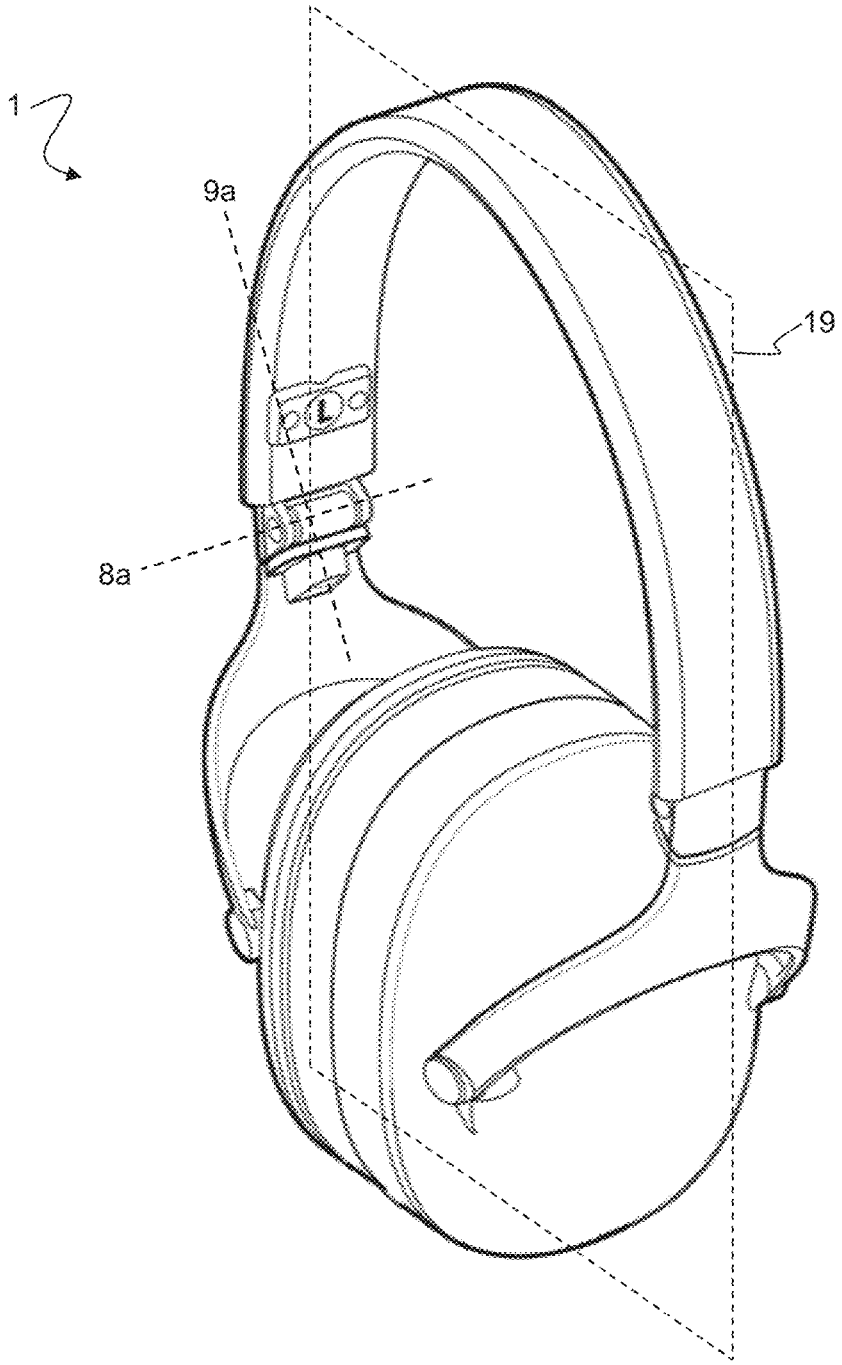
FIG. 5 is a perspective view the headphone of FIG. 1 in erected configuration, FIG. 6 corresponds to FIG. 5 but with the headphone in process of being folded to the collapsed configuration of FIG. 1.

Referring now to FIGS. 3 and 4, in the erected configuration, and also in the configuration when worn, of the headphone 1 the respective earpiece 2*a*, 2*b* is prevented from rotation around an axis 12*a*, 12*b* that is normal to the headband 4. Such an axis may also be termed a transverse axis 12*a*, 12*b* to the headband 1. The joint structures 5*a*, 5*b* are configured such that, when the headphone 1 is in the erected configuration, the pivot axes 9*a*, 9*b* of the pivot joints 7*a*, 7*b* are arranged at an angle with respect to the headband section where the joint structures 5*a*, 5*b* are positioned. As is clear from the figures, the pivot axes 9*a*, 9*b* are arranged at an angle, denoted a in FIG. 3, with respect to said transverse axes 12*a*, 12*b*. In the shown example, the pivot axes 9*a*, 9*b* are arranged at an angle $\alpha$ of 55 degrees with respect to the transverse axes 12*a*, 12*b*. As long as there is a substantial angle, at least 30 degrees, between the pivot axes 9*a*, 9*b* and the transverse axes 12*a*, 12*b*, the earpieces 2*a*, 2*b* are prevented from rotation around the transverse axis 12*a*, 12*b*. It is of particular importance to prevent the rotation when the headphone is in the erected configuration and the angle $\alpha$ between the pivot axes 9*a*, 9*b* and the transverse axes 12*a*, 12*b* is defined in the erected or fully un-collapsed configuration. However, with the above-described design, said rotation will be prevented also in a partly collapsed configuration, such as when the hinge joints 6*a*, 6*b* have been folded up to 10 degrees.

Figure 1:
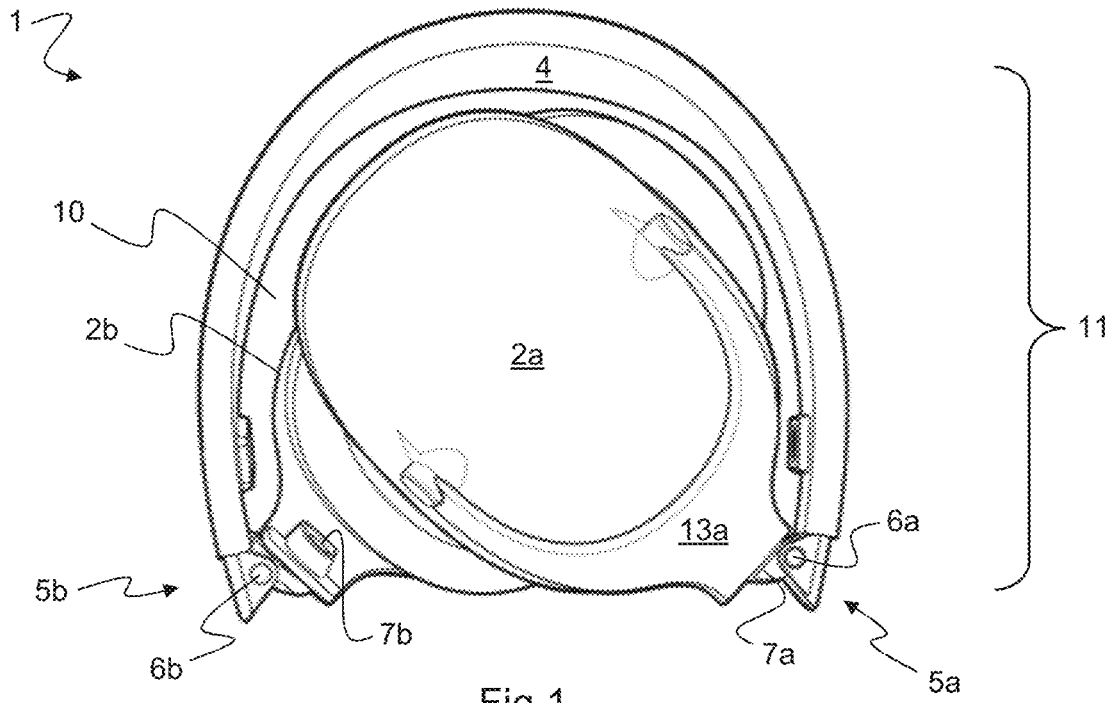
FIG. 1 is a plan view of a headphone in a collapsed configuration in which the inner sides of earpieces are arranged essentially in parallel with a headband and face each other.
Figure 2:
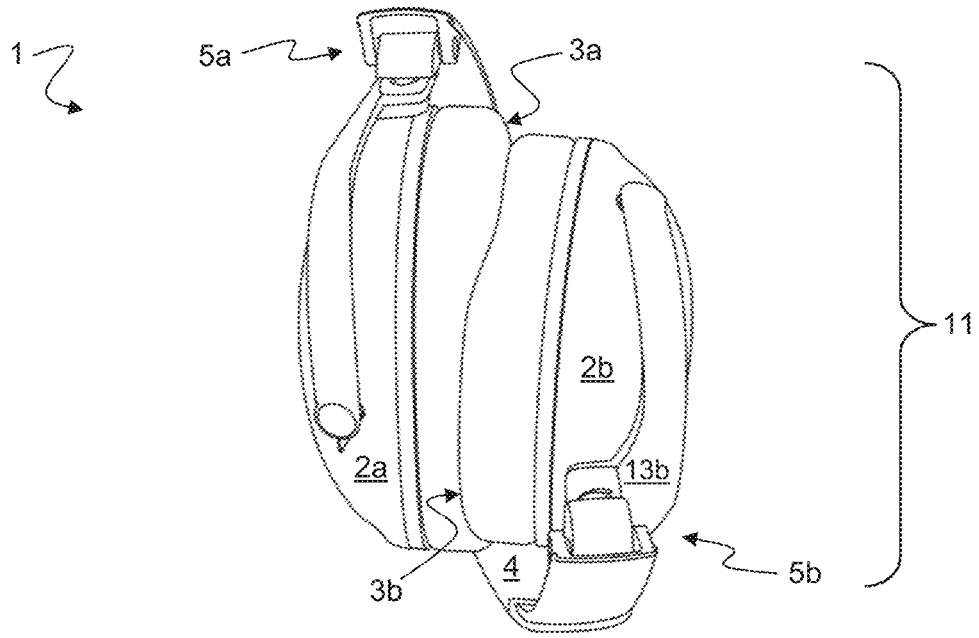
FIG. 2 is side view of FIG. 1.

FIGS. 1 and 2 illustrate the headphone 1 in a collapsed configuration or storage configuration. In this configuration, the inner sides 3*a*, 3*b* of the earpieces 2*a*, 2*b* face each other. The earpieces 2*a*, 2*b* are rotated approximately a quarter turn in the collapsed configuration. The inner sides 3*a*, 3*b* may rest against each other and preferably be slightly pressed towards each other. The headphone 1 may be configured such that the earpieces 2*a*, 2*b* remain the collapsed configuration, such that the headphone stays in the collapsed configuration in the absence of external influence. The earpieces 2*a*, 2*b*, more precisely the inner sides 3*a*, 3*b* thereof, lie essentially in the headband plane 19 in the collapsed configuration. In other words, the earpieces 2*a*, 2*b*, and thus the inner sides 3*a*, 3*b* thereof, are arranged essentially in parallel with the headband.

FIG. 6 illustrates a part of a procedure of folding the headphone 1 from the erected configuration to the collapsed configuration. These configurations may also be termed listening or worn configuration and storage configuration, respectively. When the headphone 1 is in the erected configuration, there is no folding of the hinge joints 6*a*, 6*b*, in other words no folding around the hinge axes 8*a*, 8*b*. In FIG. 6, the respective earpieces 2*a*, 2*b* have been rotated 90 degrees around the respective pivot axis 9*a*, 9*b* to face each other and be in parallel with the headband 4. The rotation of the right earpiece 2*b* is illustrated by the small curved double arrow around the right pivot axis 9*b*. The headphone 1 may be stored in this configuration, even though not as compact as the collapsed configuration shown in FIGS. 1 and 2. The next step towards the collapsed configuration is to fold the respective earpiece 2*a*, 2*b* around the respective hinge axes 8*a*, 8*b*, as is illustrates by the two larger curved double arrows. The earpieces 2*a*, 2*b* may be folded until they are positioned adjacent the headband 4, as is illustrated in FIG. 1.

In the collapsed configuration, there is essentially no gap 10 between the headband 4 and the earpieces 2*a*, 2*b*. In other words, as seen in a plan view the earpieces 2*a*, 2*b* occupy essentially all the available area inside the curvature of the headband 4. FIG. 1 shows an exaggerated gap 10 between the headband 4 and the earpieces 2*a*, 2*b*. The dimension of any gap 10 in a direction transverse to the headband 4 does not exceed the thickness, or even half the thickness, of the headband 4 in the same direction. In other words, there is preferably no gap 10 that exceeds the thickness of the headband 4, or half thereof, as measured in the headband plane 19 at any point of the headband 4 that lies against the head of a user when worn.

FIG. 1 and FIG. 2 illustrate that the height 11 of the headband 4 essentially corresponds to the dimension of the earpieces 2*a*, 2*b* in the collapsed configuration. The headband height 11 and the earpiece 2*a*, 2*b* dimension are here measured along a height axis running through the middle of the headband 4 and through a point located equally distanced between the respective headband ends 4*a*, 4*b*. The height 11 of the headband 4 is the distance from the central point of the headband 4 to a midpoint between the ends 4*a*, 4*b* of the headband in the headband plane 19. The ends 4*a*, 4*b* of the headband 4 are where the hinge joints 6*a*, 6*b* are located. In the collapsed configuration, the dimension of the oblong earpieces 2*a*, 2*b* as measured along the height axis is shorter than the dimension of the oblong earpieces 2*a*, 2*b* along their longitudinal axes as the earpieces 2*a*, 2*b* are folded around the hinge joints 6*a*, 6*b* and thus oblique to said axis.

Figure 10:
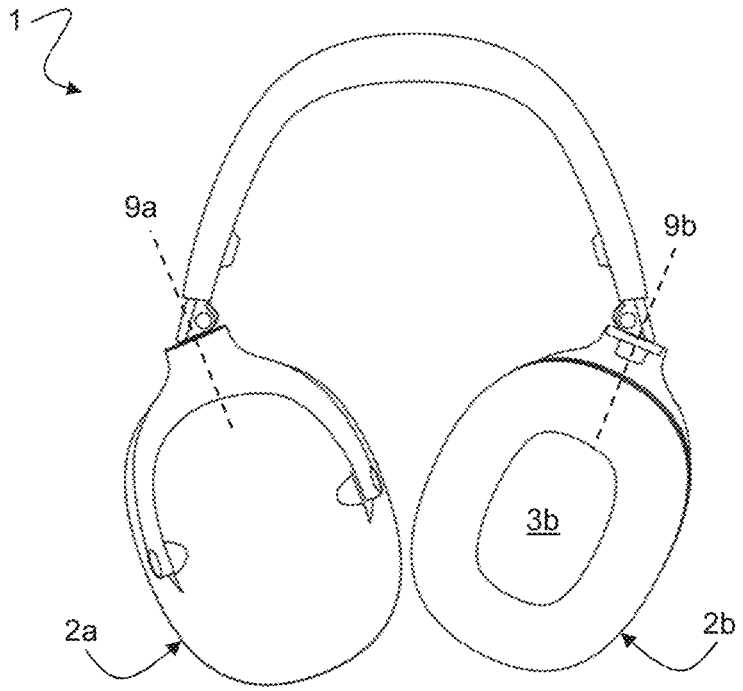
FIG. 10 shows the headphone of FIG. 3 with the earpieces rotated 90 degrees in opposite directions, as seen in the plan view, around the pivot joints, and FIG. 11 corresponds to FIG. 10 with the earpieces rotated in the respective opposite directions.

FIG. 10 shows the headphone 1 with the left earpiece 2*a* rotated a pivot angle of 90 degrees around the pivot axis 9*a* of the left pivot joint 7*a*. As a comparison, in FIG. 3 the pivot angle is 0 degrees as the earpieces 2*a*, 2*b* are in their neutral rotational positions. In the neutral rotational positions the earpieces 2*a*, 2*b*, more particularly the inner sides 3*a*, 3*b* thereof, are perpendicular to the headband plane 19. Referring again to FIG. 10, the right earpiece 2*b* is rotated a pivot angle of 90 degrees in the opposite direction, as seen in the plan view, compared to the left earpiece 2*a*. Thus, the pivot joints 7*a*, 7*b* allow each earpiece 2*a*, 2*b* to be rotated 90 degrees in both rotational directions.

Figure 11:
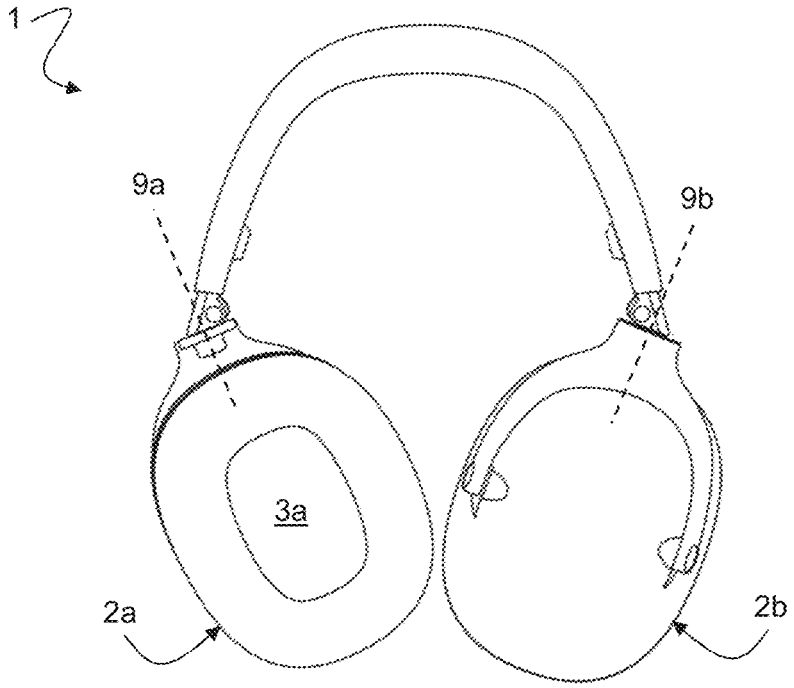

Even though not illustrated, there are typically cables, such as power and/or signal cables, running between the earpieces 2*a*, 2*b* and the headband 4. For cable wear reasons, it is desired to limit the allowed movement of the earpieces 2*a*, 2*b* with respect to the headband 4. The pivot joints 7*a*, 7*b* may be configured to allow the respective earpieces 2*a*, 2*b* to rotate up to but not exceeding a maximum pivot angle in both rotational directions around the neutral rotational position. The maximum pivot angle may be 90 degrees, which would correspond to what is shown in FIGS. 10 and 11 if these illustrated the maximum allowed rotations of the earpieces.

A maximum pivot angle of 90 degrees is preferred as it provides a headphone 1 that can be collapsed to the above-described collapsed configuration while the cable wear is minimised. Depending on the design of earpieces 2*a*, 2*b*, for example as regards the thickness of the earpiece cushions, a greater maximum pivot angle may be beneficial for collapsing the headphone into the collapsed configuration. A maximum pivot angle of 120 degrees may be preferred over 90 degrees. However, maximum pivot angles of up to 150 or even 180 degrees are adequate.

The headband 4 may be furnished with telescoping joints 16*a*, 16*b* comprising telescoping joint elements 18*a*, 18*b* linearly movable within the headband 4 at the headband ends 4*a*, 4*b*. A first end of the respective telescoping joint element 18, 18*b* is configured to be inserted into a corresponding channel in the headband 4 though an opening at the headband end 4*a*, 4*b*. A second end of the respective telescoping joint element 18, 18*b* carries the joint structures 5*a*, 5*b*. More precisely, the second end of the respective telescoping joint element 18, 18*b* is connected to the hinge joint 6*a*, 6*b*. The telescoping joints allow adjustment of the length of the headband 4 by extending and retracting the headband 4 to fit the headphone 1 to a user's head size. The headphone is preferably designed such that the telescoping joints 16*a*, 16*b* are arranged in the retracted condition when the headphone is in the collapsed configuration, as is shown in FIG. 1. This results in a compact collapsed configuration with the telescoping joint elements 18*a*, 18*b* protected from mechanical damage and other wear.

As can be seen in the figures, in particular in FIGS. 3-5 and 10-11, the headphone 1 of the exemplified embodiment comprises two planes of symmetry. The headband plane 19 is a plane of symmetry. A plane of symmetry can be drawn perpendicular to the headband plane 19, equally distanced from the two earpieces 2*a*, 2*b*. One half of the headband 4 and a first earpiece 2*a* is equally shaped as the other half of the headband 4 and a second earpiece 2*b*. The joint structures 5*a*, 5*b* are of equal shapes. As regards the symmetries and the equal shapes, there may be embodiments in which labelling (L and R), control buttons, openings for power/signal cables and microphones need be disregarded.

In the collapsed configuration, the headband 4 may be slightly warped as is illustrated in FIG. 2. For this reason, it may not be correct to state that in the collapsed configuration the inner sides 3*a*, 3*b* are arranged in parallel with the headband 4, but rather essentially in parallel with the headband 4. Adhering to the earlier definition of the headband plane 19, the headband plane may be warped in the collapsed configuration. Another reason for stating that the inner sides 3*a*, 3*b* are arranged essentially in parallel, and not in parallel, with the headband in the collapsed configuration is that the pivot joints 7*a*, 7*b* may allow the earpiece 2*a*, 2*b* to be slightly rotated out of the headband plane 19 when in the collapsed configuration.

The degree to which the headband is warped when in the collapsed configuration will depend on the overall design of the headphone 1 such as the thickness of the earpiece 2*a*, 2*b* cushions and the design of the joint structures 5*a*, 5*b*. It may be preferred to design the headphone 1 such that the headband 4 is warped in the collapsed configuration (FIG. 2) as this may help the headphone stay or remain in the collapsed configuration. The warp of the headband 4 may cause the earpieces 2*a*, 2*b* to interlock and remain the in the collapsed configuration. In the collapsed configuration, the earpieces 2*a*, 2*b* may be urged or pressed against each other thanks to the headband 4 being warped. The headband 4 is made from a flexible and resilient material.

As is clear from FIGS. 1-6 and 10-11, the headband 4 does not comprise any linkage or similar that allows the headband 4 as such to be collapsed. The headband 4 maintains its general form of a curved beam also in the collapsed configuration of the headphone 1, but the radius of curvature of the headband 4 may be decreased.

Earpiece support structures 13*a*, 13*b* may be provided to connect the joint structures 5*a*, 5*b* to the earpieces 2*a*, 2*b* as is illustrated in the exemplified embodiment. More precisely, the earpiece support structures 13*a*, 13*b* connect the pivot joints 7*a*, 7*b* to the earpieces 2*a*, 2*b*. One end of the respective earpiece support structure 13*a*, 13*b* is connected to the respective pivot joint 7*a*, 7*b* and the other end is connected to the earpiece 2*a*, 2*b*. The earpiece support structures 13*a*, 13*b* may be yoke shaped, as is shown in the figures. The respective earpiece 2*a*, 2*b* is attached to an earpiece support structure 13*a*, 13*b* by means of two earpiece pivot joints 14*a*, 14*b* that allow to earpieces 2*a*, 2*b* to swivel, as is indicated by the double arrow in FIG. 3, and help the headphone 1 fit various head sizes and shapes. In particular as said swivelling of the earpieces 2*a*, 2*b* can align their inner sides 3*a*, 3*b* to lie flat against the head of a user while the flexible headband 4 is adjusted to the size of the head. When there is no swivel around the earpiece pivot joints 14*a*, 14*b* and the earpieces 2*a*, 2*b* are arranged flush against the earpiece support structures 13*a*, 13*b* as shown in FIG. 6, an axis drawn from the pivot joint 7*a*, 7*b* through the earpiece 2*a*, 2*b* is parallel with the respective pivot axis 9*a*, 9*b*. It is to be noted that the earpiece pivot joints 14*a*, 14*b* are not necessary for bringing the headphone 1 to the collapsed configuration, see FIG. 2.

The earpieces 2*a*, 2*b* may have a circular form as seen from the respective inner side 3*a*, 3*b*. In the illustrated example, the earpieces 2*a*, 2*b* have an oblong form as seen from the respective inner side 3*a*, 3*b* as is clear from e.g. FIGS. 10 and 11. The oblong form fits the shape of the ear of a user.

FIG. 3 discloses a headphone 1 with a control device 15*b*, such as a function button, integrated in an earpiece joint 14*b*. The control device 15*b* may be a push button. The earpiece joint 14*b* supports the earpiece 2*b* and connects the earpiece 2*b* to the headband 4 of the headphone 1. Preferably, the control device 15*b* is integrated in the earpiece joint 14*b*. In the example shown, the control device 15*b* is a push button 15*b* that is integrated in the earpiece pivot joint 14*b*, the push button 15*b* being smaller than the outer dimension of the earpiece pivot joint 14*b*. The push button 15*b* is resiliently linearly movable in the direction of the earpiece pivot joint axis. The headphone 1 with the control device 15*b* may correspond to the one described with reference to FIGS. 1-11. There may be provided control devices in all four earpiece joints, or only in one, two or three earpiece joints. Preferably, as is shown in FIG. 3, the earpiece joint 14*b* is located away from the outer surface of the earpiece 2*b*, whereby there is less risk that the control device 15*b* is activated by mistake e.g. by the user leaning the head towards an object and thus bringing the outer surface of the earpiece 2*a*, 2*b*, which outer surface is opposite the earpiece inner side 3*a*, 3*b*, in contact with the object. In the shown example, the earpiece joint 14*b* is located on a lateral side of the earpiece 2*a*, 2*b* and thus directed approximately 90 degrees away from the surface of the head of the user when the headphone 1 is worn.

What is claimed is:

1. A headphone comprising:

earpieces comprising inner sides facing the head of a user when the headphone is worn;

a headband; and joint structures connecting the earpieces to the headband, each joint structure comprising a hinge joint and a pivot joint, wherein the hinge joints connect the earpieces to the headband via the pivot joints, and each hinge joint comprises a hinge axis and each pivot joint comprises a pivot axis, the hinge axes being non-parallel to the pivot axes, and wherein the headphone is collapsible to a collapsed configuration where said inner sides are arranged essentially in parallel with the headband and facing each other, wherein the pivot joints allow the earpieces to rotate around respective pivot axes up to but not exceeding a maximum pivot angle in both rotational directions around a neutral rotational position in which the pivot angle equals 0 degrees.

2. The headphone of claim 1, wherein the hinge joints allow the pivot joints and earpieces to fold around respective hinge axes towards the headband until the earpieces are positioned adjacent the headband.

3. The headphone of claim 1, wherein the maximum pivot angle is 180 degrees.

4. The headphone of claim 1, wherein the maximum pivot angle is 150 degrees.

5. The headphone of claim 1, wherein the maximum pivot angle is 120 degrees.

6. The headphone of claim 1, wherein a form of the headband, a form of the earpieces, a movement allowed by the hinge joints, and a movement allowed by the pivot joints are selected such that there is essentially no gap between the headband and the earpieces in the collapsed configuration.

7. The headphone of claim 1, wherein, the height of the headband essentially corresponds to the height of the earpieces in the collapsed configuration.

8. The headphone of claim 1, wherein the joint structures are of equal shape.

9. The headphone of claim 1, wherein a left half of the headband and a left earpiece of the earpieces are of equal shape, respectively, as a right half of the headband and a right earpiece of the earpieces.

10. The headphone of claim 1, wherein the headphone is configured to remain in the collapsed configuration.

11. The headphone of claim 1, further comprising telescoping joints allowing a length of the headband to be adjusted.

12. The headphone of claim 1, further comprising earpiece support structures connecting the joint structures to respective earpieces, each earpiece support structure comprising an earpiece joint.

13. The headphone of claim 12, wherein the earpiece support structures are yoke shaped and each earpiece support structure comprises two earpiece pivot joints.

14. The headphone of claim 12, further comprising a control device integrated in one of the earpiece joints.

15. The headphone of claim 14, wherein the control device comprises a function button.

16. A headphone comprising:

earpieces comprising inner sides facing the head of a user when the headphone is worn;

a headband; and joint structures connecting the earpieces to the headband, each joint structure comprising a hinge joint and a pivot joint, wherein the hinge joints connect the earpieces to the headband via the pivot joints, and each hinge joint comprises a hinge axis and each pivot joint comprises a pivot axis, the hinge axes being non-parallel to the pivot axes, and wherein the headphone is collapsible to a collapsed configuration where said inner sides are arranged essentially in parallel with the headband and facing each other, wherein the respective joint structure is configured to prevent rotation of the earpiece around a transverse axis to the headband in the area of the joint structure, and wherein the joint structures are configured such that the pivot axis is arranged at an angle of at least 30 degrees with respect to the transverse axis.

* * * * *